US008245427B2

(12) United States Patent
Gomez

(10) Patent No.: US 8,245,427 B2
(45) Date of Patent: Aug. 21, 2012

(54) FIRING PIN SAFETY DEVICE FOR AUTO-LOADING FIREARMS

(75) Inventor: Jesus S. Gomez, Trappe, MD (US)

(73) Assignee: LWRC International, LLC, Cambridge, MD (US)

( * ) Notice: Subject to any disclaimer, the term of this patent is extended or adjusted under 35 U.S.C. 154(b) by 146 days.

(21) Appl. No.: 12/456,047

(22) Filed: Jun. 10, 2009

(65) Prior Publication Data

US 2010/0313459 A1 Dec. 16, 2010

(51) Int. Cl.
*F41A 17/24* (2006.01)

(52) U.S. Cl. ..... 42/70.08; 89/154

(58) Field of Classification Search ..... 42/70.08; 89/154

See application file for complete search history.

(56) References Cited

U.S. PATENT DOCUMENTS

| | | | | | |
|---|---|---|---|---|---|
| 1,359,609 | A * | 11/1920 | Lang | 89/149 |
| 2,848,832 | A | 8/1958 | Lee | |
| 4,057,003 | A * | 11/1977 | Atchisson | 89/138 |
| 4,352,317 | A * | 10/1982 | Wilhelm | 89/154 |
| 4,555,861 | A * | 12/1985 | Khoury | 42/69.01 |
| 5,223,649 | A * | 6/1993 | Claridge | 42/70.01 |
| 5,437,120 | A * | 8/1995 | Dornaus | 42/70.08 |
| 5,778,587 | A | 7/1998 | Brandl | |
| 6,044,748 | A * | 4/2000 | Westrom | 89/185 |
| 6,145,234 | A * | 11/2000 | Fluhr | 42/70.08 |
| 6,530,168 | B2 * | 3/2003 | Shimi et al. | 42/70.08 |
| 6,560,908 | B2 | 5/2003 | Murello | |
| 6,718,680 | B2 * | 4/2004 | Roca et al. | 42/70.08 |
| 7,373,752 | B2 * | 5/2008 | Bubits | 42/70.08 |
| 2002/0020100 | A1 * | 2/2002 | Roca et al. | 42/70.11 |
| 2009/0101000 | A1 * | 4/2009 | Rawson-Harris | 89/183 |
| 2009/0151213 | A1 * | 6/2009 | Bell | 42/69.03 |

FOREIGN PATENT DOCUMENTS

DE 4207252 A1 * 9/1993

* cited by examiner

*Primary Examiner* — Benjamin P Lee
*Assistant Examiner* — Joshua Freeman
(74) *Attorney, Agent, or Firm* — Jacobson Holman PLLC

(57) ABSTRACT

A firing pin safety catch mechanism for a firearm, especially an auto-loading firearm which operates with a closed action such as found on the United States Military's M16 and its various derivatives. The firearm includes a firing pin which is housed within a bolt carrier group and which is capable of being moved from a rest position in which its proximal end is out of the travel path of the hammer to a firing position. The safety catch mechanism includes a safety catch, a pin and a spring for biasing the safety catch to hold the firing pin in its rest position to prevent the unintentional movement of the firing pin and thereby prevent the unintentional discharge of the host firearm. The safety catch includes a cam surface cooperating with the hammer so that the catch is released from engagement with the firing pin when the hammer has substantially completed its path of travel.

10 Claims, 4 Drawing Sheets

FIRING PIN SAFETY DEVICE FOR AUTO-LOADING FIREARMS

BACKGROUND OF THE INVENTION

1. Field of Invention

The invention relates in general, to firearms, and more particularly, to a spring loaded firing pin safety catch mechanism designed to prevent the unintentional discharge of a firearm.

2. Prior Art

Numerous firing pin safety devices have been developed and implemented over the years with a varying degree of success. These safety devices have the general purpose of preventing the unintentional discharge of a firearm should the weapon be violently struck from the front (for example, if the firearm accidentally falls on the group causing the muzzle of the weapon to strike a potentially hard surface), or should debris become wedged between the firing pin and its housing causing the firing pin to be stuck in the firing or primed position.

Firing pins of the "floating" variety, which do not have any mechanical means preventing the tip from contacting the primer of a cartridge, are common in both the M16 and AK family of firearms. The M16 and its derivates are arguably the most prolific type of firearm in the United States being used by military, law enforcement and civilian shooters. When a hammer strikes the rear end of the firing pin ("front" is understood throughout this document to mean the direction that a discharged projectile would leave the host firearms barrel and "rear" is understood to be opposite of "front") its energy is transferred to the firing pin which responds by moving forward through the separation distance and striking the primer of the loaded cartridge being held by the barrel's chamber.

Unfortunately, kinetic energy may also be imparted to a floating firing pin unintentionally such as when a weapon is dropped by the user accidentally. Another possibility, when the action of the firearm is released after being drawn fully to the rear, upon seating the firing pin, due to inertia, is still traveling forward only stopping after it strikes the primer of the loaded cartridge. This often leads to a small dimple of the primer's surface. These provided examples, under the right circumstance, could cause a weapon to accidentally discharge.

Devices such as discussed in U.S. Pat. Nos. 2,848,832 & 6,145,234 propose a catch-like safety mechanism mounted to the breech of a firearm. These safety mechanisms rely on a catch which faces the firing pin. The firing pin has a recess proximate its rear end. The recess is located opposite the safety catch or circumferential about the rear end (in the case of U.S. Pat. No. 6,145,234) located opposite the safety catch formed on the safety element. A means to force the safety catch into operational contact with the firing pin recess is provided by both designs. When the safety catch is engaged with the recess, the firing pin is secured and cannot move toward the primer of a cartridge.

In the above mentioned safety elements, the safety element are lengthened rearward by a release part having a camming surface. The camming surface of the release parts extends into the travel path of the hammer directly behind the rear of the firing pin. When the hammer strikes the camming surface, and in so doing, forcing the release part, and thus the safety element to the side such that the firing pin is released by the safety catch just prior to the firing pin being struck by the hammer. This results in the firing pin being able to move under the pressure exerted by the hammer resulting in the firearm discharging a round.

While the above described safety mechanisms are effective, they are not readily adaptable to the M16 family of weapons. Nothing in these prior art examples would create an operative combination. Further, as example, U.S. Pat. No. 6,145,234 incorporates the extractor element into the leaf spring used in conjunction with the safety catch. There is no way to incorporate such a design into the M16 family of weapons due to the rotational separation of the bolt from the bolt carrier during normal operation. Yet, a need to implement a mechanism which prevents the "floating" movement of the firing pin in the M16 family of weapons and those like it persist.

Another weakness with prior art firing pin safeties is that they allow the firing pin a limited range of motion even when held in the rest position. The forward inertia generated when the action is closed coupled with the movement still allowed the firing pin allows the tip of the firing pin to dimple the primer. While it has not been proven that this situation causes out of battery detonation of the loaded cartridge there is evidence that suggest it does. Out of battery detonation occurs when a loaded cartridge is discharged prior to the bolt and cartridge being fully seated in the chamber of the host firearm.

It would be highly advantageous, therefore, to remedy the foregoing and other deficiencies inherent in the prior art.

3. Objects and Advantages

Accordingly several objects and advantages of the present invention are (a) To provide a safety mechanism which prevents the unintentional movement of the firing pin assembly in an auto-loading firearm during manual cycling of the action.

(b) To provide a safety mechanism which may be readily implemented into existing rifle designs.

(c) To provide a safety catch mechanism which may be incorporated into the existing, M16 family of firearms, bolt carrier assembly.

(d) To prevent any unintentional contact between the firing pin and the primer of a cartridge.

Still further objects and advantages will become apparent from a consideration of the ensuing description and drawings.

SUMMARY

The herein disclosed invention consists of a firing pin safety catch mechanism designed for use with a firearm having a separate bolt carrier group and a trigger mechanism. The bolt carrier group includes a bolt carrier and a bolt. The trigger mechanism includes a hammer, firing pin, and a firing spring. The hammer is movable from a cocked position through a path of travel to strike the firing pin. The firing pin spring biases the firing pin into a rest position wherein the tip of the firing pin is not protruding through the face of the bolt. The firing pin has a proximal end and a catch surface, or recess, adjacent the proximal end. The firing pin safety catch mechanism consists of a coil spring, roll pin, and safety catch which are assembled on the bolt carrier. The safety catch is disposed in proximity to the proximal end of the safety catch mechanism and has a first position wherein the safety catch engages the catch surface, or recess, of the firing pin in the rest position and a second position wherein the safety catch disengages with the recess to release the firing pin for movement out of the rest position. The coil spring places force on the distal end of the safety catch mechanism which rotates on the provided roll pin to bias the safety catch into the first position. The safety catch includes a camming surface on the proximal end of the safety catch. Also, the camming surface is disposed within the motion path of the hammer. When the safety catch mechanism is in the first position such that, as the hammer moves from the cocked position through the travel path, the hammer cams the camming surface of the safety catch against the force being applied by the coil spring to move the safety catch from the first position to the second position, allowing the hammer to strike the proximal end of the firing pin thus forcing it forward into the primer of a loaded cartridge.

Other features and advantages are inherent in the disclosed apparatus or will become apparent to those skilled in the art from the following detailed description and its accompanying drawings.

DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
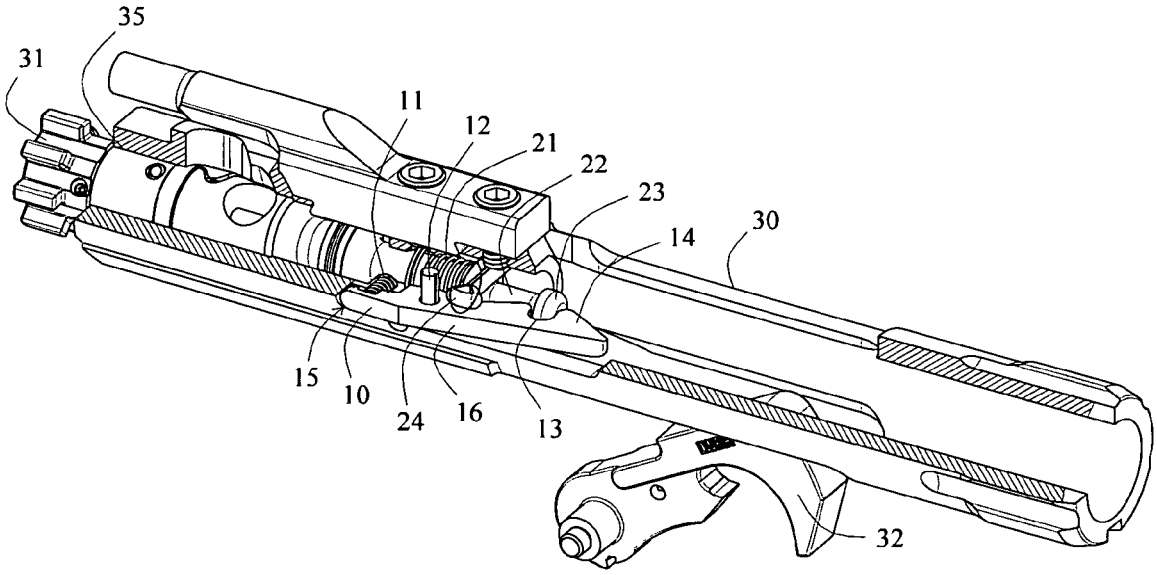
FIG. 1 is a side perspective view of my firing pin safety device for auto-loading firearms.

Turning now to the drawings in which like reference characters indicate corresponding elements throughout the several views, as used herein, the word "front" or "forward" corresponds to the end of the bolt carrier assembly where the bolt is located (i.e., to the left as shown in FIGS. 1 thru 4); "rear" or "rearward" or "back" corresponds to the direction opposite the end of the bolt carrier assembly where the bolt is located (i.e., to the right as shown in FIGS. 1 thru 4). The word "proximal" corresponds with the end closest to the shooter, while the word "distal" refers to the end closest to the muzzle of the barrel. The bolt carrier group includes a bolt carrier 30 and a bolt 31.

FIG. 1 illustrates a side perspective view of the preferred embodiment bolt carrier 30 and bolt 31 which has been machined, with a guide groove 15, to accept the parts comprising the safety catch mechanism 10. The safety catch mechanism 10 consist of a spring 11, roll pin 12, safety catch arm 16, safety catch 13 and a camming surface 14. Optionally a, prior art, retaining pin 24 may be used to further prevent the firing pin 20 from falling free of the bolt carrier 30.

Figure 2:
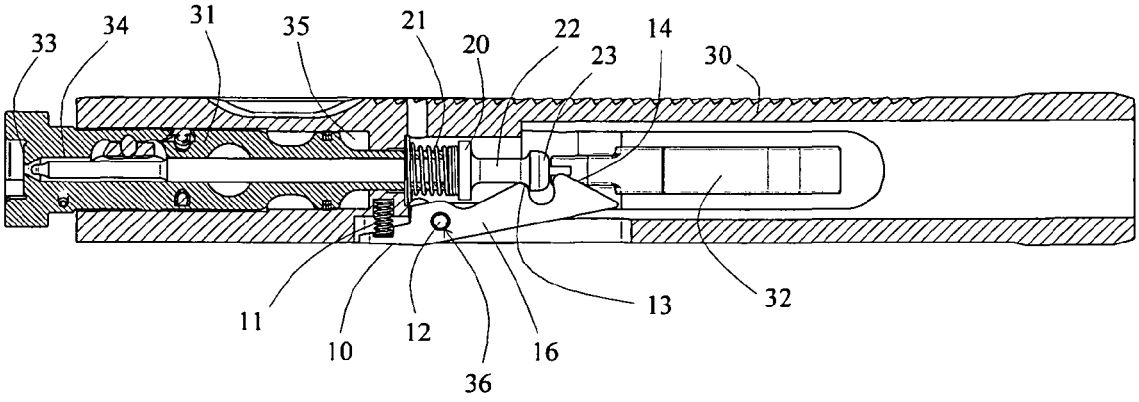
FIG. 2 is a longitudinal sectional view of the firing pin safety catch with the firing pin captured by the safety catch and the hammer in a cocked position.

The firing pin safety catch mechanism 10 disclosed herein is shown in FIG. 2 in its' preferred embodiment. The depicted bolt 31 has a recess 33 on its forward area where a loaded cartridge (not shown) rests in the recess 33. When a trigger (not shown) is operated, the hammer 32 is released from its cocked position to travel through its motion path to a fired position (shown in FIG. 4.) resulting in the firing pin 21 protruding through the face of the recess 33 of the bolt 31.

The bolt 31 has a first longitudinal receiving bore 34 formed therein to house the firing pin 20. A second longitudinal receiving bore 35 is formed in the front or distal end of the bolt carrier 30 to contain the bolt 31. The firing pin 20 is rearwardly biased into its rest position (shown in FIG. 2) by a firing pin spring 21 mounted between the first longitudinal bore 34 and the firing pin 20 recess 22. The rest position is defined by the interaction of the recess 22, which is located near the proximal end of the firing pin 20 and the safety catch 13 which is located at the proximal end of the safety catch arm 16. The proximal section of the first longitudinal bore 34 has a larger diameter than the distal section of the bore or receiving hole 34. When the firing pin 20 is in the rest position, the rear or proximal end of the firing pin 20 protrudes from the proximal end of the second longitudinal receiving bore 35 and extends into the travel path of the hammer 32. Further, when the firing pin 20 is in the rest position, the tip, or front, of the firing pin 20 is spaced so that it does not protrude from the bolt face 33.

Figure 4:
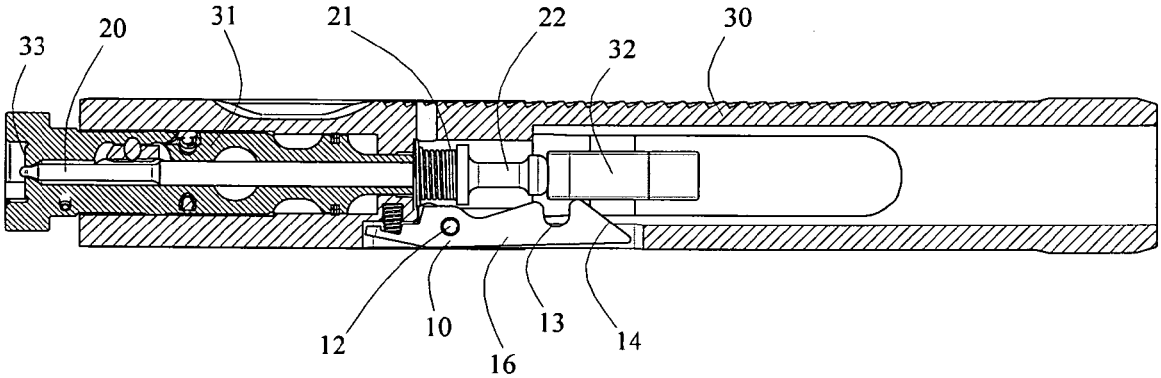
FIG. 4 is a similar view to that of FIG. 2, but shows the position of the safety catch mechanism and firing pin after the hammer has completed its full path of travel.

When the hammer 32 makes contact with the rear 23 of the firing pin 20, the firing pin 20 moves forward against the force of the firing pin spring 21 until the firing pin 20 is protruding far enough to ignite the primer of a loaded cartridge (not shown) as seen in FIG. 4. In this illustrated example, the firing pin 20, is of the "floating" variety in that, as a result of the hammer 32 striking the proximal end of the firing pin 20, kinetic energy is transferred from the hammer 32 to the firing pin 20, which imparts this transferred energy to the primer of the loaded cartridge.

As illustrated in FIG. 1, a guide groove 15 is milled into the side of the bolt carrier 30. The guide groove 15 is a narrow opening which is milled from the outside surface of the bolt carrier into the hollow center of the bolt carrier group. The guide groove 15 has a section where the spring 11 is disposed at its distal end, and a bore 36 which transverses the guide groove 15 approximate its mid point for housing the roll pin 12 which secures the safety catch mechanism 10 in place. A coil type spring 11 is typically used to biases the safety catch arm 16 which is machined from steel.

The first longitudinal bore 34 is formed by the standard practices used to manufacture a bolt 31 for the M16 series of firearms. A round opening is present at both the proximal and distal ends of the first longitudinal bore 34 formed through the bolt 31.

The second longitudinal receiving bore 35 extends from the distal end of the bolt carrier 30 to approximately its mid point. The bolt 31 operates, in general, substantially like a prior art bolt in a prior art bolt carrier. The distal end of the second longitudinal bore 35 is open to receive the bolt 31 and at the proximal end to receive the firing pin 20.

The safety catch mechanism 10 has a portion, the safety catch 13, which is machined on the proximal end and protrudes into the path of the firing pin 20. The safety catch 13 has a caroming surface 14 machined onto its proximal end which increasingly extends into the travel path of the hammer 32. The proximal end of the safety catch 13 is positioned just to the side and behind the proximal end of the firing pin 20.

In the rest position illustrated in FIG. 2, safety catch 13 engages the recess 22 located at the proximal end of the firing pin 20. The hammer 32 is in the cocked position.

Figure 3:
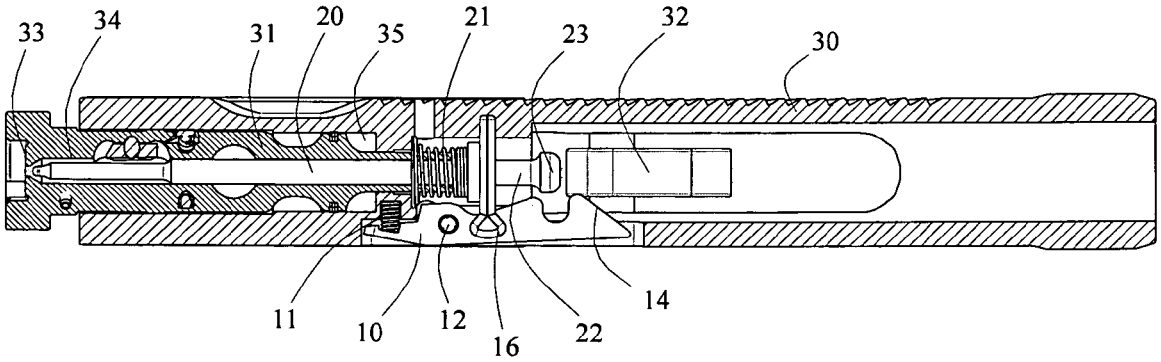
FIG. 3 is a similar view to that of FIG. 2, but shows the hammer pushing aside the safety catch immediately prior to striking the hammer.

FIG. 3 shows an example, of the herein described device, wherein the hammer 32 is released and moves forward and encounters and runs along the camming surface 14 of the safety catch mechanism 10. When the hammer 32 encounters the camming surface 14, it forces the safety catch 13 to the side against the spring 11 action on the rear part of the safety catch mechanism. As a result, the annular recess 22 and thus the firing pin 20 are released to move from the first position to the second position. The safety catch 13 then lies laterally against the hammer 32 and remains so positioned during the further movement of the hammer 32 so that the safety catch 13 remains situated in the release position.

The outer end of the annular recess 22 and the rear end of the safety catch 13 facing the firing pin 20 are each preferably provided with a chamfer. The chamfers on these surfaces are complementary. If the firing pin 20 is not moved back into its rest position after a shot is fired, the firing pin spring 21 forces the firing pin 20 and thereby the recess 22 back until the safety catch 13 engages the recess 22 surface.

FIG. 4 shows how after the hammer 32 strikes the proximal end of the firing pin 20, the firing pin 20 moves forward since the safety catch 13 remains in its release position. When the firing pin 20 exits through the hole in the bolt face 33 it strikes the primer igniting the loaded cartridge (not shown).

During reloading, the bolt 31 pushes a new cartridge from the magazine (not shown) forward, into the chamber of the barrel (not shown) until the bolt 31 seats against the proximal end of the chamber (not shown). As the bolt 31 contacts the barrel chamber it rotates within the bolt carrier 30. During this rotation of the bolt 31 the firing pin spring 21 is further compressed between the rear of the bolt 31 and the flange present along the distil end of the recess 22 located on the firing pin 20. This increase of tension applies additional force to the firing pin 20 thereby moving it into its rest position.

From the foregoing, persons of ordinary skill in the art will appreciate that the disclosed firing pin safety device for auto-loading firearms is advantageous with respect to other prior art firing pin safety devices in that, for example, it may be adapted, with minor modifications, to the existing bolt carrier group used by the M16 family of firearms. Further it has very few moving parts allowing for higher operational reliability. The herein disclosed device is readily implemented into the M16 family of firearms. In particular, the disclosed device achieves these objectives by implementing a safety element including a safety catch mechanism 10, spring 11 and roll pin 12 which is placed onto the existing bolt carrier design and interacts with the prior art firing pin.

In principle, it is possible to produce a safety catch mechanism by machining the parts from unhardened steel billet, and to heat treat it to the desired hardness. Other technologies such as metal injection molding may be used to reduce the cost associated with machining the parts from billet. The spring may be produced from any heat resistant steel that is capable of repeatedly bearing a load. A roll pin of hardened steel may be purchased from any number of suppliers.

During assembly, a spring 11 is placed within a void located at the distal end of the guide groove 15. The safety catch mechanism 10 is placed in the groove 15 and depressed within. After the bore 36 for the roll pin 12 lines up with the void (not shown) in the safety catch mechanism 10, located proximately in its center, the roll pin 12 is driven into place. This orientation has the proximal end, where the safety catch 13 is located, protruding into the hollow within the bolt carrier 30. The guide groove 15 which houses the safety catch mechanism 10 supports the majority of its length to thereby prevent deflection during normal operation and to ensure reliable positioning of the safety catch 13 on the firing pin 20 recess 22. The remaining assembly necessary is identical to that which is required in the prior art.

Conclusion, Ramifications, and Scope

Accordingly the reader will see that I have provided a firing pin safety device for auto-loading firearms which offers several advantages over the prior art. There herein, disclosed device prevents the unintentional discharge of a firearm which is the result of a "floating" firing pin. The herein described device will eliminate contact between the firing pin and the primer of a loaded cartridge which the firing pin is in contact with the safety catch mechanism. My device is designed to interact with the M16 family of weapons and the herein disclosures offers a means by which it may be incorporated, nevertheless this is not intended to limit the scope of this invention, rather, merely describe the preferred embodiment of the herein disclosed design.

While my above drawings and description contain much specificity, these should not be construed as limitations on the scope of the invention, but rather as an exemplification of one preferred embodiment thereof.

Accordingly, the scope of the invention should be determined not by the embodiments illustrated, but by the appended claims and their legal equivalents.

What is claimed is:

1. A safety device for use with a firearm comprising:

an M16 type bolt carrier group including a bolt having a first longitudinal bore housed within a bolt carrier having a second longitudinal bore for receiving the bolt, the first longitudinal bore being generally surrounded by the second longitudinal bore and the bolt being rotatable within said bolt carrier;

a firing pin positioned for reciprocating movement within the first longitudinal bore between a first position, where the tip of the firing pin is protruding from the face of the bolt of the bolt carrier group, and a second position wherein the firing pin is restrained, a proximal end of the firing pin including a catch surface;

a hammer translatable from a cocked position through a travel path;

a firing pin spring cooperating with the firing pin and a proximal end of the bolt to bias the firing pin toward the second position; and a safety catch mechanism housed within a guide groove formed as an opening through an exterior side wall of said bolt carrier group and located adjacent to the second longitudinal bore, the safety catch mechanism having a safety catch arm with a distal end which biases against a safety catch spring disposed within the bolt carrier, a proximal end of the safety catch arm including a safety catch positioned to selectively engage the catch surface of the firing pin to selectively secure the firing pin in the second position, the safety catch spring biasing the safety catch into engagement with the catch surface, the proximal end of the safety catch mechanism including a camming surface disposed within the travel path of the hammer so that the hammer applies force against the camming surface as the hammer moves from the cocked position through the travel path to rotate the safety catch mechanism to disengage the safety catch from the firing pin catch surface to thereby release the firing pin for movement from the second position to the first position.

2. The safety device for use with a firearm as defined in claim 1 wherein said safety catch spring is housed within a section of the guide groove located on an interior of said bolt carrier group and positioned adjacent the distal end of said safety catch mechanism such that the spring biases the distal end of the safety catch mechanism towards an exterior of said bolt carrier group.

3. The safety device for use with a firearm as set forth in claim 1, wherein said safety catch mechanism includes a transverse bore at about a midpoint thereof for receiving a pin about which the safety catch mechanism pivots.

4. The safety device for use with a firearm as defined in claim 1 wherein the safety catch surface of the firing pin is an annular recess near the proximal end of the firing pin.

5. A safety device for a firearm having a bolt carrier group from the M16 family of firearms with a bolt having a first longitudinal bore housed within a bolt carrier having a second longitudinal bore for receiving the bolt, the first longitudinal bore being generally surrounded by the second longitudinal bore and the bolt being rotatable within said bolt carrier, a hammer translatable from a cocked position through a travel path, a firing pin positioned for reciprocating movement within the first longitudinal bore between a firing position, where the tip of the firing pin is protruding from the face of the bolt of the bolt carrier group, and a rest position in which the firing pin is restrained, a proximal end of the firing pin including a catch surface, and a firing pin spring cooperating with the firing pin and a proximal end of the bolt to bias the firing pin toward the rest position, said safety device comprising:

a safety catch mechanism including a safety catch arm with a safety catch, a pin and a safety catch spring, said safety catch arm having a proximal end and a distal end, said proximal end including a camming surface and said safety catch being located adjacent to and distal from the camming surface, said safety catch spring being housed within a recess located on an interior of said bolt carrier group and positioned adjacent the distal end of said safety catch arm, said spring biasing the distal end of the safety catch arm toward an exterior of said bolt carrier group, said safety catch arm including a transverse bore at about a midpoint thereof for receiving the pin, said safety catch arm being rotatable on said pin from an engaged position in which said safety catch secures said firing pin in said rest position to a disengaged position in which said catch surface of said firing pin is released from said safety catch to allow the firing pin to move to the firing position, said safety catch spring biasing the safety catch arm into the engaged position, said safety catch arm rotating to said disengaged position in response to force applied by the hammer moving forwardly and riding along the camming surface to force the proximal end of the safety catch arm away from the firing pin to release the catch surface of the firing pin from the safety catch and allow the firing pin to move to the firing position.

6. The safety device as set forth in claim 5, wherein said safety catch spring is supported on the bolt carrier.

7. The safety device as set forth in claim 5, wherein the safety catch mechanism is located within a guide groove formed as an opening through an exterior side wall of said bolt carrier group and located adjacent to said second longitudinal bore.

8. The safety device as set forth in claim 7, wherein the recess housing the safety catch spring is part of said guide groove.

9. The safety device as set forth in claim 5, wherein the catch surface of the firing pin is an annular recess near the proximal end of the firing pin.

10. The safety device as set forth in claim 5, wherein the catch surface of the firing pin is an annular recess near the proximal end of the firing pin.

* * * * *